US009568227B2

(12) United States Patent
Douglas et al.

(10) Patent No.: US 9,568,227 B2
(45) Date of Patent: Feb. 14, 2017

(54) SYSTEMS AND METHODS FOR REFRIGERANT CHARGE DETECTION

(71) Applicant: Lennox Industries Inc., Richardson, TX (US)

(72) Inventors: Jonathan Douglas, Lewisville, TX (US); Robert B. Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 564 days.

(21) Appl. No.: 14/173,579

(22) Filed: Feb. 5, 2014

(65) Prior Publication Data

US 2015/0219376 A1 Aug. 6, 2015

(51) Int. Cl.
*F25B 49/00* (2006.01)
*F25B 49/02* (2006.01)

(52) U.S. Cl.
CPC ..... *F25B 49/02* (2013.01); *F25B 2500/19* (2013.01); *F25B 2600/23* (2013.01); *F25B 2600/2519* (2013.01); *F25B 2700/04* (2013.01); *F25B 2700/151* (2013.01); *F25B 2700/1931* (2013.01); *F25B 2700/1933* (2013.01); *F25B 2700/2106* (2013.01)

(58) Field of Classification Search
CPC ..... F25B 2700/04; F25B 2700/151; F25B 2500/222; F25B 2500/22; F25B 2500/23; F25B 2500/24; F25B 2600/05; F25B 49/02
See application file for complete search history.

(56) References Cited

U.S. PATENT DOCUMENTS

| | | | | |
|---|---|---|---|---|
| 3,243,969 | A * | 4/1966 | Dirk | F25B 45/00 62/125 |
| 5,623,834 | A | 4/1997 | Bahel et al. | |
| 6,170,277 | B1 * | 1/2001 | Porter | F04B 49/225 62/196.2 |
| 6,205,798 | B1 * | 3/2001 | Porter | G01M 3/2876 62/129 |
| 6,272,868 | B1 | 8/2001 | Grabon et al. | |
| 6,615,594 | B2 | 9/2003 | Jayanth et al. | |
| 6,679,072 | B2 | 1/2004 | Pham et al. | |
| 6,758,051 | B2 | 7/2004 | Jayanth et al. | |
| 2002/0173929 | A1 | 11/2002 | Seigel | |
| 2003/0115890 | A1 | 6/2003 | Jayanth et al. | |
| 2005/0086952 | A1 * | 4/2005 | Nonaka | F25D 11/022 62/129 |

FOREIGN PATENT DOCUMENTS

CA 2344908 A1 1/2002

OTHER PUBLICATIONS

Kim, Minsung, et al., "Design of a steady-state detector for fault detection and diagnosis of a residential air conditioner," International Journal of Refrigeration 31, 2008, pp. 790-799.

* cited by examiner

*Primary Examiner* — Ryan J Walters
*Assistant Examiner* — Steve Tanenbaum
(74) *Attorney, Agent, or Firm* — Hubbard Johnston, PLLC

(57) ABSTRACT

Systems and methods are disclosed for detecting a refrigerant charge in a cooling system. The systems and methods involve performing at least a partial pump down of the refrigerant while monitoring one or more metrics. The measured metrics may be compared to a standard in order to determine if a refrigerant leak has occurred or to determine other refrigerant information. Other systems and methods are disclosed.

8 Claims, 2 Drawing Sheets

SYSTEMS AND METHODS FOR REFRIGERANT CHARGE DETECTION

FIELD

This application is directed, in general, to heating, ventilating and air conditioning or cooling (HVAC) systems, and more specifically, to methods and systems for detecting a refrigerant charge.

BACKGROUND

Heating, ventilating, and air conditioning (HVAC) systems can be used to regulate the environment within an enclosed space. Typically, an air blower is used to pull air (i.e., return air) from the enclosed space into the HVAC system through ducts and push the air into the enclosed space through additional ducts after conditioning the air (e.g., heating, cooling or dehumidifying the air). Unless otherwise indicated, as used throughout this document, "or" does not require mutual exclusivity. Various types of HVAC systems may be used to provide conditioned air for enclosed spaces.

HVAC systems as well as refrigeration systems utilize a refrigerant to receive and discharge heat through a cycle. The refrigerant charge, or level, within the system can impact the efficiency of the system. For example, if an HVAC system is has a suboptimal refrigerant charge, the cooling efficiency of the system will be compromised at some level. Leaks of refrigerant during operation can cause the refrigerant charge to become compromised.

BRIEF DESCRIPTION

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

According to one illustrative embodiment, systems and methods are presented that provide a diagnostic tool to develop refrigerant information for HVAC or refrigeration system. The methods and systems may determine a relative change of refrigerant or an absolute quantity of refrigerant.

Figure 1:
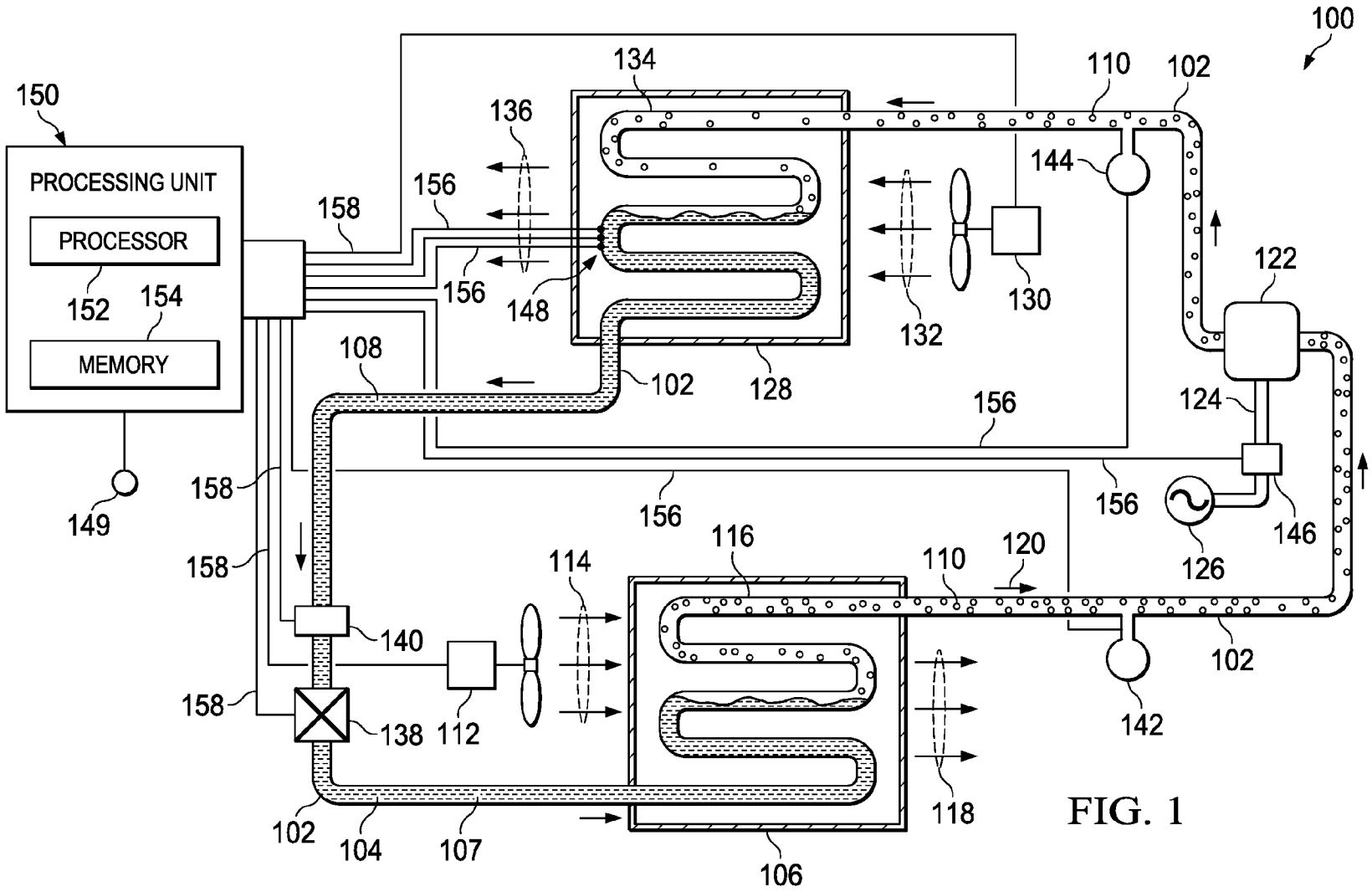
FIG. 1 is a schematic diagram of a cooling system according to an illustrative embodiment of the invention.

Referring now primarily to FIG. 1, a cooling system 100 for cooling a target area, e.g., the interior of a house if it is an HVAC or the interior of refrigerator if a refrigeration system. The system 100 includes a closed, circuitous conduit 102 containing a refrigerant 104, or working fluid. In normal operation, the refrigerant 104 will travel throughout the closed, circuitous conduit 102 in liquid, gas, or a mixed phase. In general terms, the refrigerant 104 is a substance that is used in the system 100 that allows a reversible phase transition from a liquid to a gas and back. Many substances may be used as refrigerants. In the past, fluorocarbons, e.g., chlorofluorocarbons, were used as refrigerants, but have since been deemed harmful to the environment. Today, other refrigerants, such as ammonia, non-halogenated hydrocarbons (e.g., propane), or hydroflurocarbons (e.g., R-410A) are used. Any suitable refrigerant may be used.

The system 100 includes evaporator 106 that is fluidly coupled to the closed, circuitous conduit 102. The evaporator 106 turns the refrigerant 104 from a two-phase mixture of liquid and gas 107 into a single-phase gas 110 while receiving heat. Thus, the liquid refrigerant in the evaporator 104 is evaporated. An evaporator blower 112 may be associated with the evaporator 104 for moving warm return air 114 over the evaporator 106, and typically over the evaporator coils 116. The warm return air 114 is cooled as heat is rejected to the evaporator 106 and thereby produces cooled air 118. The cooled air 118 is also conditioned thereby with respect to humidity. The refrigerant 104, in gas phase, moves in the direction shown by arrow 120 and is delivered to a compressor 122.

The compressor 122 is fluidly coupled to the closed, circuitous conduit 102 and receives the refrigerant 104 from the evaporator 106. The refrigerant 104 is typically a low-pressure gas when the refrigerant 104 arrives at the compressor 122 where work is added to increase the energy and heat of the refrigerant 104. A power cable 124 is shown electrically coupling the compressor 122 with a power source 126. The refrigerant 104 is delivered from the compressor 122 to a condenser 128 as a relatively hot, high pressure gas.

The condenser 128 is fluidly coupled to the closed, circuitous conduit 102 and receives the refrigerant 104 from the compressor 122. The condenser 128 is typically located outside the structure to be cooled and is used to reject the heat into the environment or to another heat sink. A condenser fan or blower 130 may be used to move ambient, outside air 132 across the condenser 128, e.g., across condenser coils 134, which typically have fins (not shown) associated with the coils 134. The ambient, outside air 132 receives the heat and exits the condenser 128 as warmer outbound air 136. As the refrigerant 104 is cooled it is changed from a gas to a liquid. The refrigerant 104 is delivered from the condenser 128 as a liquid 108 to a metering device 138, or expansion valve.

The metering device 138 is fluidly coupled to the closed, circuitous conduit 102 and receives the refrigerant 104 in liquid phase. The closed, circuitous conduit 102 or a portion between the condenser 128 and the metering device 138 may be referred to a liquid line. A shutoff valve 140 may be included on the closed, circuitous conduit 102 between the condenser 128 and the metering device 138 or elsewhere on the closed, circuitous conduit 102 between the condenser 128 and the evaporator 106. The shutoff valve 140 may be automated to close upon receiving instructions. Moreover, the metering device 138 may comprise the shutoff valve 140 in some embodiments. One example is an electronic expansion valve that opens and closes a metering port in response to a control signal. When commanded to the closed position, the electronic expansion valve acts as a shut-off valve. Other devices may be included on the closed, circuitous conduit 102 between the condenser 128 and the metering device 138 such as a drier (not shown) or sight glass (not shown). The refrigerant 104 is delivered from the metering device 138 to the evaporator 106 via the closed, circuitous conduit 102. In some embodiments, the metering device 138 is an intake portion of the evaporator 106 itself.

In the evaporator 106, the heat absorption causes the refrigerant 104 to change from a two-phase mixture of gas and liquid 107 to a gas 110. The cycle continues around the closed, circuitous conduit 102. This system 100 works well if the proper charge of refrigerant 104 is established and maintained. Unfortunately, at times, a proper amount of the refrigerant 104 is not loaded into the system 100 and at other times refrigerant 104 leaks from the system 100 leaving a less than optimal refrigerant level or charge in the system 100. The systems and methods herein seek to develop refrigerant information to determine that a change in refrigerant level has occurred or to determine the quantity of refrigerant in the system.

The system 100 also includes one or more transducers associated with the closed, circuitous conduit 102 for monitoring one or more metrics associated with the system 100. For example, without limitation, the system 100 may include a low-pressure-side pressure transducer 142 or a high-pressure-side transducer 144. The low pressure side typically references the portion of the closed, circuitous conduit 102 between the metering device 138 and the compressor 122 on the side of the evaporator 106, and the high pressure side typically references the portion of the closed, circuitous conduit 102 between the compressor 122 and the metering device 138 on the side of the condenser 128. The one or more transducers may also include a power transducer 146 on the cable 124 for measuring current or otherwise measuring power used by the compressor 122. The one or more transducers may include one or more liquid level sensors 148, which may be coupled to a portion of the closed, circuitous conduit 102 within the condenser 128 for detecting the presence of liquid phase refrigerant therein. The liquid level sensors 148 may be located at other locations as well. The one or more transducers are communicatively coupled to a processing unit 150 by wireless signals or by conductive wires.

The processing unit 150 includes one or more processors 152 and one or more memories 154 associated with the one or more processors 152. The processing unit 150 is used to implement the various illustrative blocks, modules, elements, components, methods and algorithms described herein. The one or more processors 152 are configured to execute one or more sequences of instructions, programming or code stored on or in the one or more memories 154, which includes all types of memory devices and includes readable medium used for storage. The processor 152 can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network or any like suitable entity that can perform calculations or other manipulations of data. The memory 154 may include one or more the following: random access memory (RAM), flash memory, read only memory (ROM), programmable read only memory (PROM), erasable PROM, registers, hard disks, removable disks, CD-ROMS, DVDs, or any other suitable storage devices. A timer in the processing unit 150 may also be considered as one of the one or more transducers for measuring elapsed time.

A plurality of cables 156 or other means may be used to communicatively couple the one or more transducers to the processing unit 150. The processing unit 150 may thereby receive data from the one or more transducers. In addition, the processing unit 150 may be communicatively coupled by cables 158 or other means to one or more of the following: the shutoff valve 140, metering device 138, evaporator blower 112, and condenser fan 130. In this example, the shutoff valve 140 or the metering device 138 are electronically actuated and controlled by the processing unit 150. The processing unit 150 may thereby control the shutoff valve 140 or metering device 138. The processing unit 150 may also control the evaporator blower 112 and condenser fan 130. As previously noted, the transducers and other devices may be communicatively coupled to the processing unit 150 by wireless signals.

According to one illustrative embodiment, a method of determining the refrigerant charge in the system 100 includes closing the shutoff valve 140 to stop the flow of the refrigerant 104 in the closed, circuitous conduit 102 at the shutoff valve 140 while continuing to operate the compressor 122. The refrigerant 104 on the low pressure side is evaporated at the evaporator 106 and moved to the high pressure side in what may be called a "pump down" process. The processing unit 150 receives cooling-system data from the one or more transducers during this process, and compares the cooling-system data against standard data to determine refrigerant information. The cooling-system data is not passively developed, but actively developed during pump down. A partial pump down, i.e., moving only some of the refrigerant, may also be used.

As a more specific illustrative, non-limiting example, the time it takes to move the refrigerant 104 from the low pressure side to the high pressure side during pump down may be measured. The processing unit 150 may know the refrigerant 104 has adequately moved by using the liquid sensors 148. The time can be compared to the standard data, which may be an average elapsed time, an initial elapsed time, modeled elapsed time, or some other standard. If it is taking longer to move the refrigerant than a previous time period, it would indicate relatively less refrigerant in the system 100 and would be indicative of a leak or inadequate initial charge or both. If it takes approximately the same time, the refrigerant 104 is remaining stable and no leak is indicated. This same determination of the refrigerant charge may be made using a partial pump down in some embodiments.

In another illustrative embodiment, at least a partial pump down is performed by the system 100 and a rate of the pressure change on the high pressure side as measured by the high-pressure-side transducer 144 is considered. The rate of change of the pressure is proportional to how full with refrigerant the condenser 128 is. If the condenser 128 is less full during the pump down as compared to a previous cycle, the pressure with increase slower than previously. If additional refrigerant is added—more than previously—the pressure will increase more quickly than previously.

It should be noted that the processing unit 150 may also account for outdoor temperature which may impact the metrics or data developed from the system 100. The system 100 may include outdoor temperature transducer 149 for this purpose, and the processing unit 150 may compensate for the changes in outdoor temperature.

In another illustrative embodiment, the amount of time (elapsed time) required for the compressor 122 to move refrigerant until a low pressure is reached whereby the compressor shut downs is measured. That time can be compared to previous times (elapsed times) or predicted times in order to make a refrigerant charge determination. Other examples and approaches will also be evident from the further explanations below.

During the methods described herein, one or both of the blowers or fans 112, 130 may continue to run, be run at partial power, or stopped.

Figure 2:
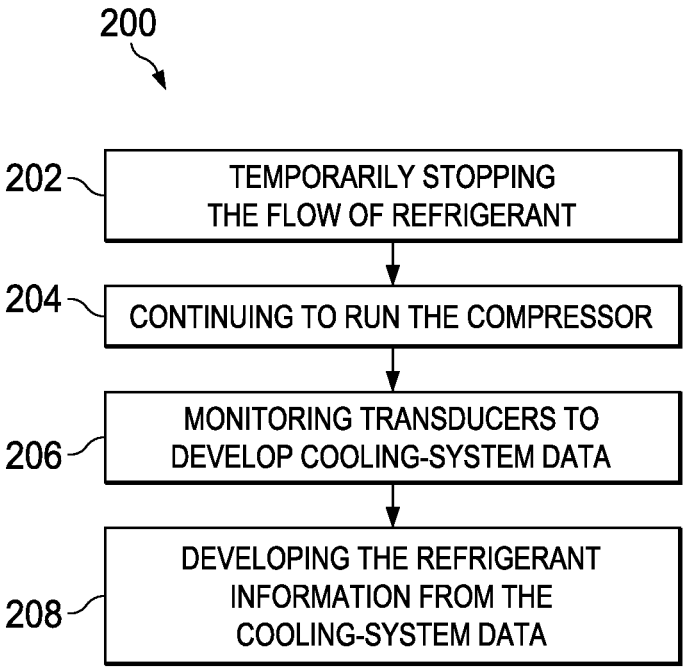
FIG. 2 is a schematic flow chart of an illustrative embodiment of a method for detecting refrigerant charge in a cooling system.

With reference now primarily to FIG. 2 and to a lesser extent to FIG. 1, an illustrative embodiment of a method 200 of determining refrigerant information in a cooling system, such as system 100 (FIG. 1), is presented. The method 200 includes temporarily stopping the flow of refrigerant in a portion of the circuitous conduit 102 as shown at 202 while continuing to run the compressor 122 as shown at 204. The flow may be stopped by having the processing unit 150 control the shutoff valve 140. Thus, at least a partial pump down is initiated. While the at least partial pump down is occurring, the one or more transducers are monitored by the processing unit 150 as suggested at 206 to develop cooling system data. The cooling system data is data from the various types of transducers that allows the quantity or relatively quantity of refrigerant to be determined. For example, the cooling system data may be elapsed time required to move the refrigerant from the low pressure side to the high pressure side to reach a liquid sensor 148 or the amount power measured by transducer 146 used over a certain interval of the pump down.

As shown at 208, the processing unit 150 develops refrigerant information from the cooling-system data. For example, the time required to move the refrigerant or the power required over a certain interval during pump may be compared to a standard, e.g., previous data, initial data, model data, etc. to determine the refrigerant charge or if a leak likely exists. While not explicitly shown in FIG. 1, the processing unit 150 may have a display for displaying that the system 100 is not leaking or to indicate that some amount of refrigerant has leaked and additional refrigerant is required.

In one illustrative embodiment, a first time period or elapsed time required to achieve a predetermined level of refrigerant in the condenser 128 is measured. Subsequently, a second time period to achieve the predetermined level of refrigerant in the condenser is measured. The first time period and second time period are compared to determine if the refrigerant is remaining constant or decreasing. This allows refrigerant charge information to be developed.

In another embodiment, the time rate of change of the refrigerant 104 during pump down is determined on the low pressure side by the low-pressure-side transducer 142. The rate of change at a specified time during pump down is compared to a standard, e.g., the rate of change from a previous run, an average from certain runs, or a modeled value, to determine if a leak exists or if the system is within a profiled range. The rate of change may also be used on the high pressure side using the high-pressure-side transducer 144 and using the same technique. In another embodiment, the pressures themselves at 142 or 144 at certain times in the pump down may be used to compare against standards to determine the refrigerant charge information.

The processing unit 150 may initiate a pump down or partial pump down to determine refrigerant charge information at set time intervals, e.g., every hour or day, or at set operational intervals, e.g., each 100 cycles of the compressor, or some other interval.

Figure 3:
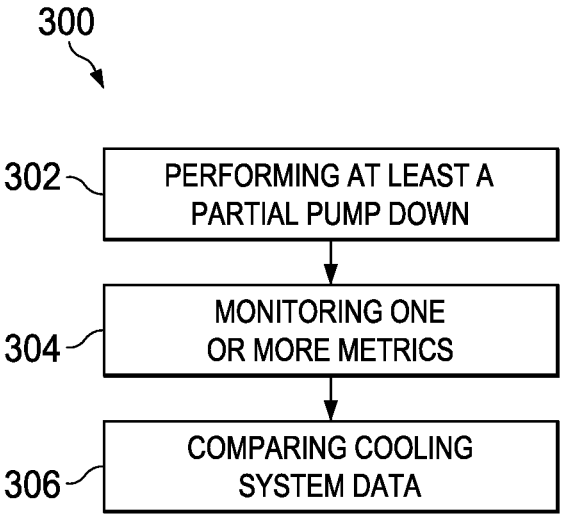
FIG. 3 is another schematic flow chart of an illustrative embodiment of a method for detecting refrigerant charge in a cooling system.

Referring now primarily to FIG. 3, and to a lesser extent to FIG. 1, an illustrative method 300 of identifying a refrigerant leak in a cooling system, e.g., system 100, is presented. The method 300 includes performing at least a partial pump down as shown at 302 by stopping refrigerant 104 flow in a portion of the cooling system 100 while continuing to run the compressor 122 in the cooling system 100 to move refrigerant from a low pressure side to a high pressure side. While doing this, the method includes monitoring one or more metrics at 304 within the cooling system 100 during the pump down to develop cooling system data. For example, the elapsed time required for liquid refrigerant to reach one or more liquid sensors 148 may be monitored or the elapsed time required for the high-pressure-side pressure transducer 144 or low-pressure-side transducer 142 to reach a pre-determined pressure or rate of charge may be monitored. Still another non-limiting example is monitoring the power used by the compressor 122 to move the refrigerant 104 or some portion thereof from the low pressure side to high pressure side.

The method further includes comparing cooling system data at 306 for a plurality of elapsed time periods to identify any relative change of the cooling system 100 with respect to refrigerant.

In an illustrative embodiment, it may be desirable to see if a proper amount of refrigerant has been loaded into a cooling system as part of commissioning. In this instance, the technician may load a prescribed amount of refrigerant based on system parameters, e.g., length of the closed, circuitous conduit 102. Then one or more cooling system metrics are measured during pump down (or partial pump down) and compared to a standard, e.g., predicted value based on laboratory test data or modeling. If the measured metrics are within a certain range of the standard value, the system is acceptably charged with refrigerant. If not, the difference in the metrics may be used to determine if too much or too little refrigerant is present in the system.

While most of the explanations herein have been in the context of air conditioners and heat pumps operating in cooling mode, it should be understood that the methods and systems may also be used with heat pumps operating in heating mode. In addition, while cooling of a building has been referenced, it should be understood that the systems and methods herein might be used with refrigeration, automobile cooling, or other applications.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A method of determining refrigerant information in a cooling system, wherein the cooling system comprises:

a closed circuitous conduit containing a refrigerant therein, an evaporator fluidly coupled to the circuitous conduit, a condenser fluidly coupled to the circuitous conduit, a compressor fluidly coupled to the circuitous conduit, and one or more transducers for measuring one or more metrics of the cooling system;

the method comprising:

temporarily stopping the flow of refrigerant in a portion of the circuitous conduit;

continuing to run the compressor;

monitoring the one or more transducers to develop cooling-system data;

developing the refrigerant information from the cooling-system data;

wherein the one or more transducers comprises one or more liquid level sensors associated with the condenser, and the cooling-system data comprises liquid level information of the refrigerant in the condenser;

measuring a first elapsed time period to reach a predetermined liquid level of refrigerant in the condenser;

subsequently measuring a second elapsed time period to reach the predetermined liquid level of refrigerant in the condenser; and comparing the first time period and second time period.

2. The method of claim 1, wherein the steps of temporarily stopping the flow of refrigerant in a portion of the circuitous conduit, continuing to run the compressor, monitoring the one or more transducers to develop cooling-system data are repeated at set time intervals.

3. The method of claim 1, wherein the steps of temporarily stopping the flow of refrigerant in a portion of the circuitous conduit, continuing to run the compressor, monitoring the one or more transducers to develop cooling-system data are repeated at set operational intervals.

4. A method of identifying a refrigerant leak in a cooling system, the method comprising:

performing at least a partial pump down comprising stopping refrigerant flow in a portion of the cooling system while continuing to run a compressor in the cooling system to move refrigerant from a low pressure side to a high pressure side;

monitoring one or more metrics within the cooling system during the pump down to develop cooling system data;

comparing cooling system data for a plurality of time periods to identify any relative change of the cooling system; and wherein monitoring one or more metrics within the cooling system comprises monitoring elapsed time required for liquid refrigerant to reach a predetermined liquid level as measured by a liquid level sensor associated with the condenser.

5. A system for cooling a target area, the system comprising:

a closed, circuitous conduit containing a refrigerant;

an evaporator fluidly coupled to the closed, circuitous conduit;

a compressor fluidly coupled to the closed, circuitous conduit;

an evaporator fluidly coupled to the closed, circuitous conduit;

a metering device fluidly coupled to the closed, circuitous conduit;

a shutoff valve fluidly coupled to the closed, circuitous conduit;

one or more transducers associated with the closed, circuitous conduit, the one or more transducers for monitoring one or more metrics associated with the system;

a processing unit having at least one processor and at least one memory, the processing unit communicatively coupled to the one or more transducers and communicatively coupled to the shutoff valve;

wherein the processing unit is configured to perform the following steps:

closing the shutoff valve to stop flow of the refrigerant in the closed, circuitous conduit at the shutoff valve, receiving cooling-system data from the one or more transducers, and comparing the cooling-system data against standard data to determine refrigerant information; and wherein the one or more transducers comprises at least one liquid level sensor in the condenser, standard data comprises cooling-system data from a previous time period and wherein the cooling-system data comprises elapsed time required for refrigerant to reach a predetermined level as measured by the at least one liquid level sensor.

6. The system of claim 5, wherein the standard data comprises cooling-system data from a previous time period.

7. The system of claim 5, wherein the standard data comprises cooling-system data from a predictive model.

8. The system of claim 5, wherein the shutoff valve comprises the metering device.

* * * * *